United States Patent [19]

Fenton

[11] Patent Number: 5,070,631

[45] Date of Patent: Dec. 10, 1991

[54] GOLF SHOE CLEAT COVER WITH GRIPPING MEMBERS HELD SLIDABLY WITHIN CHANNELS

[76] Inventor: James R. Fenton, 202 28th St., Hermosa Beach, Calif. 90254

[21] Appl. No.: 637,116

[22] Filed: Jan. 3, 1991

[51] Int. Cl.[5] ..... A43B 5/00

[52] U.S. Cl. ..... 36/127; 36/132; 36/135; 36/7.1 R; 36/15; 36/62; 36/73

[58] Field of Search ..... 36/127, 132, 135, 136, 36/7.1 R, 7.3, 7.5, 2.5, 15, 62, 73, 72 R

[56] References Cited

U.S. PATENT DOCUMENTS

| | | | |
|---|---|---|---|
| 1,811,781 | 6/1931 | Degge | 36/7.5 |
| 2,372,501 | 3/1945 | Lawrence | 36/7.5 |
| 2,958,963 | 11/1960 | Lougheed | 36/7.5 |
| 3,020,654 | 2/1962 | McCann | 37/7.5 |
| 3,858,336 | 1/1975 | Brown | 36/2.5 AN |
| 3,964,180 | 6/1976 | Cortese | 36/135 |
| 4,484,398 | 11/1984 | Goodwin et al. | 36/135 |
| 4,693,019 | 9/1987 | Kim | 36/7.3 |
| 4,872,273 | 10/1989 | Smeed | 36/135 |

*Primary Examiner*—David T. Fidei
*Assistant Examiner*—Thomas P. Hilliard
*Attorney, Agent, or Firm*—Robert M. Sperry

[57] ABSTRACT

An improved golf shoe cleat cover formed with at least one groove located on the underside of the cover and having a plurality of cleat gripping members slideably positionable within the groove to conform to the pattern and spacing of the cleats on a golf shoe to which the cover is to be attached and to releasably grip these cleats.

11 Claims, 3 Drawing Sheets

GOLF SHOE CLEAT COVER WITH GRIPPING MEMBERS HELD SLIDABLY WITHIN CHANNELS

BACKGROUND

1. Field of Invention

This invention relates to golf shoes and is particularly directed to improved covers for the spikes of golf shoes and the like.

2. Prior Art

As is widely known, golf shoes are made with spikes for enhancing the foot grip of the wearer to provided more certain stance and to prevent slipping. Unfortunately, when the golfer goes into the club house or gets into his car to drive home, the spikes tend to tear carpets, scratch floors and create other hazards. Therefore, it would be desirable to provide some means for covering the spikes when they are not needed. Obviously, such covers should be easily applied and removed, since the golfer may want to put the covers on and off repeatedly. For example, the golfer might put the covers on when he dresses at home to prevent damaging the floors and carpets of his home, and to avoid damaging the carpeting in his car as he drives to the golf course. When he arrives, he may remove the covers in order to play golf, but may wish to stop somewhere along the way for a snack or drink and may wish to cover his spikes to enter the clubhouse to do this. Subsequently, he will wish to remove the covers to complete his game and, then, may wish to put the covers on again to return home.

Another reason for using golf shoe spike covers is that the spikes tend to be very slippery on smooth, hard surfaces, such as concrete, and make it difficult for the golfer to walk safely. Furthermore, such surfaces tend to wear down the spikes quite rapidly, necessitating frequent replacement of the spikes.

As might be expected, numerous prior attempts have been made to provide removable covers for golf spikes. However, most of the prior art devices require straps or the like which are unsightly. In addition, many of the prior art devices have been difficult and time-consuming to apply and remove. Other prior art golf spike covers have tended to fall off during use, which may cause the wearer to trip and possibly injure himself. Yet other prior art golf shoe spike covers have not provided adequate protection to assure that the spikes to not scratch or tear adjacent surfaces. An additional problem with the use of golf shoe cleat covers arises from the fact that the pattern and spacing of the cleats varies from one manufacturer to another and from one size shoe to another. None of the prior art golf shoe cleat covers have been able to accommodate these differences. A search in the United States Patent Office has revealed the following:

| U.S. PAT. NO. | INVENTOR | ISSUED |
|---|---|---|
| 3,020,654 | D. H. McCann | Feb. 13, 1962 |
| 3,243,902 | D. J. Chapman | Apr. 5, 1966 |
| 3,821,858 | T. K. Haselden | July 2, 1974 |
| 3,858,336 | R. E. Brown | Jan. 7, 1975 |
| 3,913,243 | K. E. Arnold et al | Oct. 21, 1975 |
| 3,964,180 | A. M. Cortese | Jun. 22, 1976 |
| 4,258,483 | A. F. Hogue | Mar. 31, 1981 |
| 4,387,515 | D. E. Baldwin | Jun. 14, 1983 |
| 4,484,398 | B. G. Goodwin et al | Nov. 27, 1984 |

Each of these references is subject to the deficiencies noted above. Thus, none of the prior art golf shoe spike cover devices have been entirely satisfactory.

BRIEF SUMMARY AND OBJECTS OF INVENTION

These disadvantages of prior art golf shoe cleat covers are overcome with the present invention and an improved golf shoe cleat cover is provided which is readily adjustable to accommodate a wide variety of cleat patterns and spacings and which can be quickly and easily applied or removed, yet which, when applied, provides full and complete protection against marring, scratching, slipping and other hazards resulting from wearing golf shoes on non-dirt surfaces.

The advantages of the present invention are preferably attained by providing an improved golf shoe cleat cover formed with a sole having at least one channel located on the underside of the cover and having a plurality of cleat gripping members slideably positionable within the channel to conform to the pattern and spacing of the cleats on a golf shoe to which the cover is to be attached and to releasably grip these cleats.

Accordingly, it is an object of the present invention to provide an improved golf shoe cleat cover.

Another object of the present invention is to provide an improved golf shoe cleat cover which is adjustable to accommodate a wide variety of cleat patterns and spacings.

A further object of the present invention is to provide an improved golf shoe cleat cover which can quickly and easily be applied or removed, yet which, when applied, provides full and complete protection against marring, scratching, slipping and other hazards resulting from wearing golf shoes on non-dirt surfaces.

A specific object of the present invention is to provide an improved golf shoe cleat cover formed with at least one groove located on the underside of the cover and having a plurality of cleat gripping members slideably positionable within the groove to conform to the pattern and spacing of the cleats on a golf shoe to which the cover is to be attached and to releasably grip these cleats.

These and other objects and features of the present invention will be apparent from the following detailed description, taken with reference to the figures of the accompanying drawings.

DETAILED DESCRIPTION OF THE INVENTION

Figure 1:
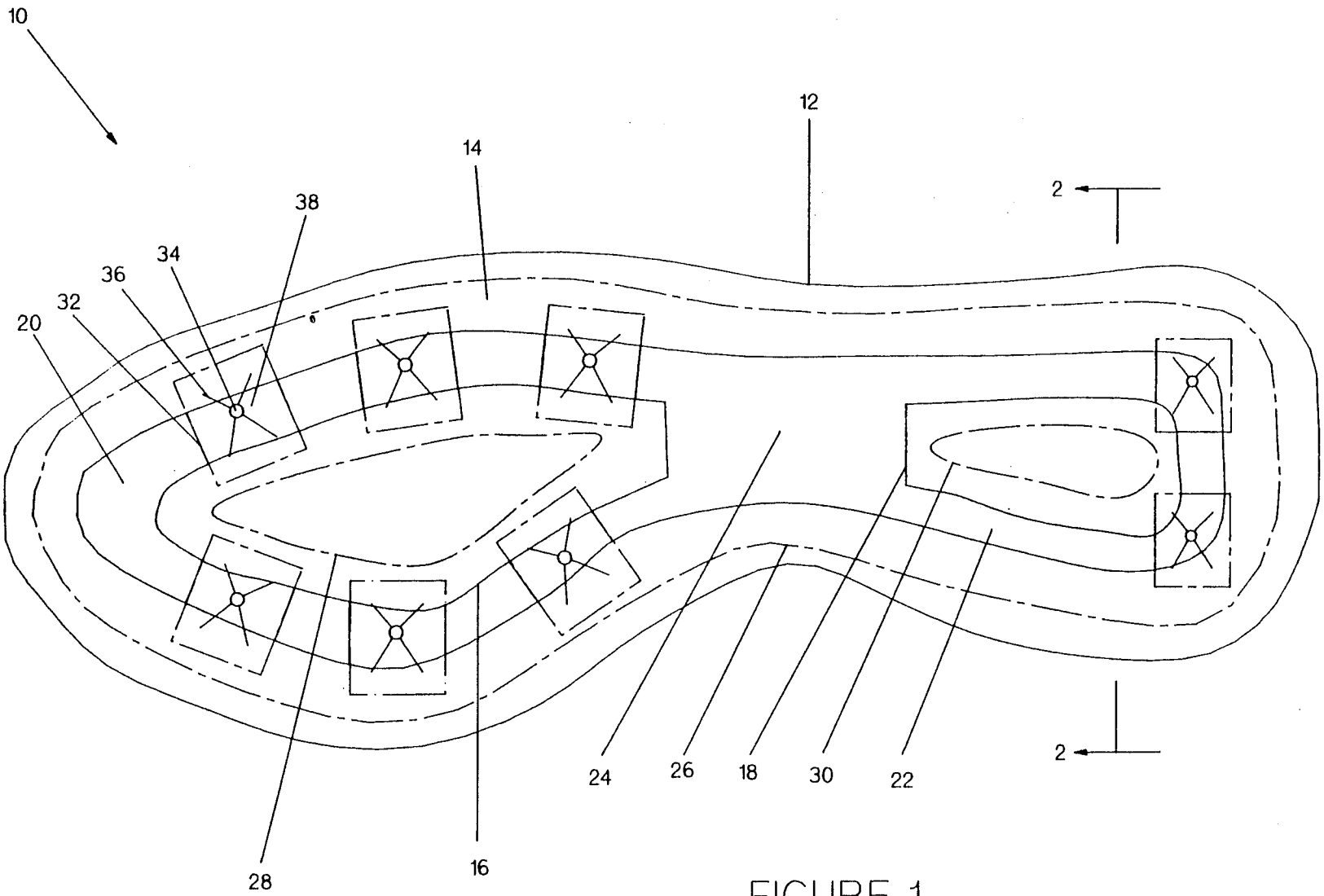
FIG. 1 is a bottom view of a golf shoe cleat cover embodying the present invention.
Figure 2:
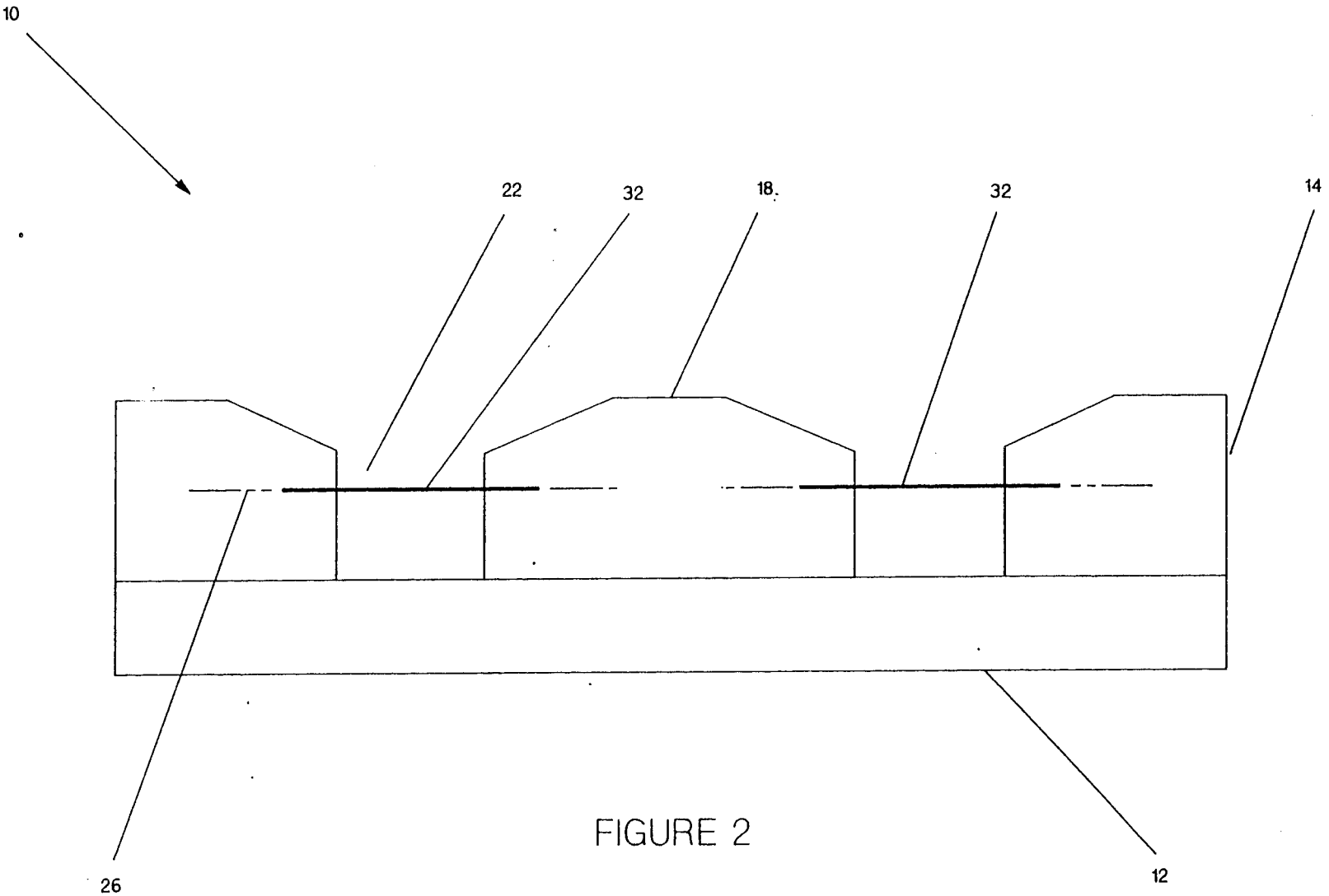
FIG. 2 is a vertical section through the golf shoe cleat cover of FIG. 1, taken on the line 2—2 thereof.
Figure 3:
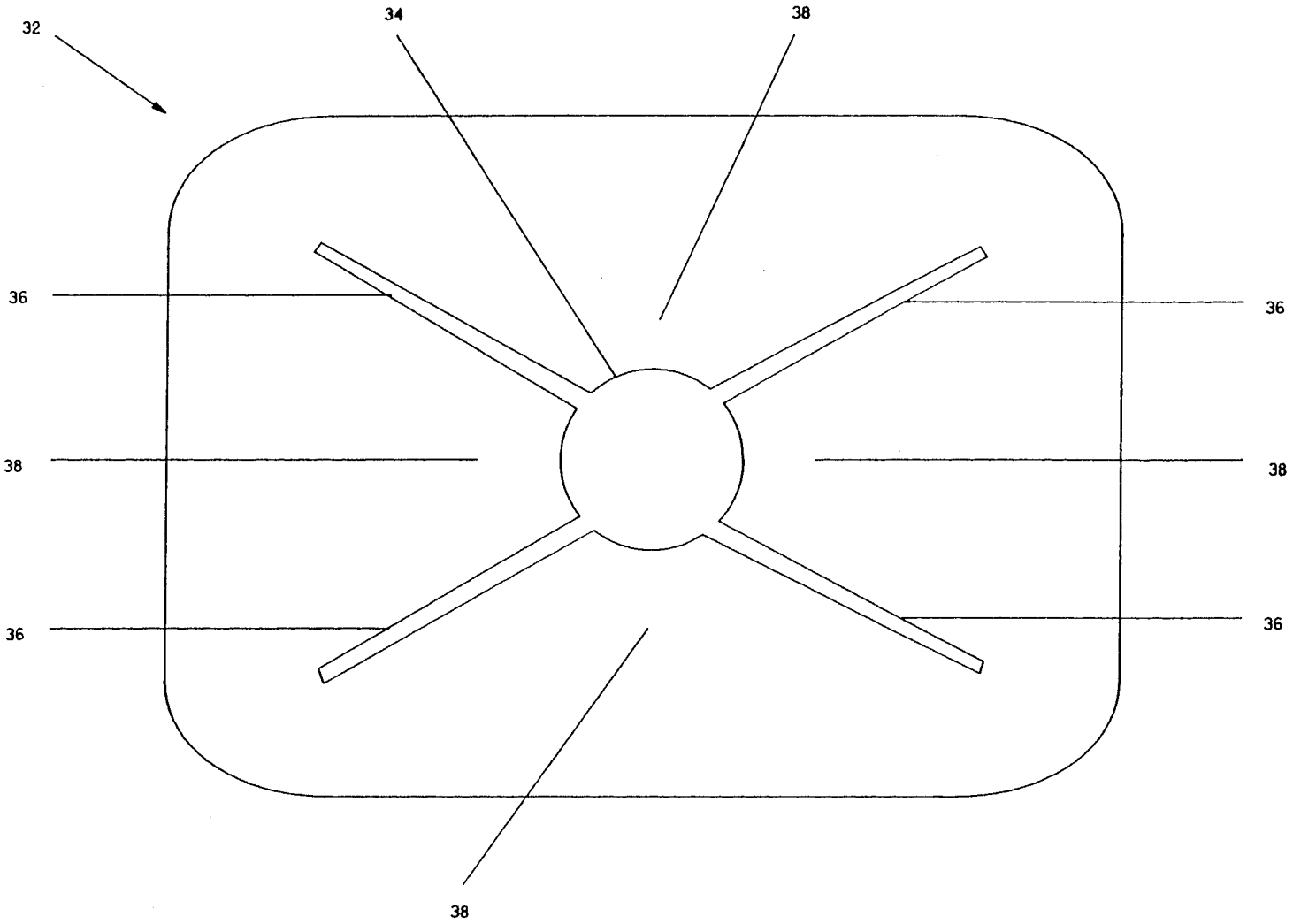
FIG. 3 is an enlarged view of one of the cleat gripping members of the golf shoe cleat cover of FIG. 1.

In that form of the present invention chosen for purposes of illustration in the drawing, FIGS. 1 and 2 show a golf shoe cleat cover, indicated generally at 10, having a sole 12 formed of suitable flexible material, such as rubber or plastic, and formed with a raised edge member 14 extending about the periphery of the sole 12 and having raised central members 16 and 18 projecting upwardly from the sole 10 and located generally centrally of the sole 10 in spaced relation to the edge member 14 so as to define channels 20 and 22. Preferably, an open area 24 is provided between the front central member 16 and the rear central member 18. The edge member 14 and central members 16 and 18 are preferably formed of the same material as the sole 10, although they may, if desired, be formed of more rigid material than the sole 12. Also, the edge member 14 and central members 16 and 18 are provided with lateral slits 26, 28 and 30 which open toward the channels 20 and 22. Finally, a plurality of cleat gripping members 32 are slideably mounted in the slits 26, 28 and 30 and are adjustably positionable along the slits 26, 28 and 30. As seen in FIGS. 1 and 2, the distance from the outer limit of slit 26 in edge member 14 across the intervening one of the channels 20 or 22 to the inner limit of the slit 28 or 30 in the adjacent central member 16 or 18 is greater than the width of the gripping members 32. This permits lateral adjustment of the position of the gripping members 32, as well as adjustment of the position of the gripping members 32 along the channels 20 or 22. The lateral dimensions of the open area 24 are preferably greater than the lateral dimensions of the gripping members 32, which permits gripping members to be added or removed by inserting the gripping members into the open area 24 and, thence, inserting the gripping members into either slits 26 and 28 adjacent channel 20 between the edge member 14 and the front central member 16 or into slits 26 and 30 adjacent channel 22 between the edge member 14 and the rear central member 18. As best seen in FIG. 3, each of the gripping members 32 is a generally rectangular sheet of strong, yet resilient material, such as metal, and each is formed with a central opening 34, of lesser diameter than that of a standard golf shoe cleat, and four slits 36, forming an X-shaped pattern about the opening 34, and defining four resilient tabs 38 which serve to releasably grip the cleats of the golf shoe to which the cleat cover 10 is applied.

In use, the golfer initially prepares the golf shoe cleat cover 10 by obtaining a number of the gripping members 32 corresponding to the number of cleats on the golf shoe to be protected. The golfer then inserts the gripping members 32 through opening 24 in the center of the cleat cover 10 and into either slit 26 of edge member 14 and slit 28 of the front central member 16 or into slit 26 of edge member 14 and slit 28 or the rear central member 18. Each of the gripping members 32 is then slid along either channel 20 or channel 22 until it is in a position corresponding to the location of a respective one of the cleats on the golf shoe to be protected. As noted above, the gripping members 32 may also be adjusted laterally by moving the gripping member 32 toward or away from the edge member 14, as needed, to facilitate mating with the corresponding cleat on the golf shoe to be protected. While it is preferable that the number of gripping members correspond, in number and location, to all of the cleats of the golf shoe to be protected, this is not essential and a lesser number of the gripping members 32 may be employed, provided that they are distributed relatively uniformly about the cleat cover 10. Once the cleat cover 10 has been prepared in this manner, the cleat cover 10 may be applied to the golf shoe quickly and easily by simply pressing the cleat cover 10 against the cleats of the golf shoe to be protected, causing the cleats to enter the openings 34 of the gripping members 32. Because the openings 34 of the gripping members 32 are of lesser diameter than the cleats, the resilient tabs 38 will releasably grip the cleats and, hence, will attach the cleat cover 10 to the golf shoe with the sole 12 of the cleat cover 10 extending below the ends of the cleats to protect the cleats from damage and to protect adjacent surfaces from being marred or scratched by the cleats. When it is desired to remove the cleat cover 10, the golfer simply grasps the edge member 14 and peels the cleat cover 10 away from the golf shoe, thereby disengaging the cleats from the gripping members 32.

Obviously, numerous variations and modifications can be made without departing from the spirit of the present invention. Therefore, it should be clearly understood that the form of the present invention described above and shown in the figures of the accompanying drawings is illustrative only and is not intended to limit the scope of the present invention.

What is claimed is:

1. A golf shoe cleat cover comprising:

a sole corresponding generally to the sole of a golf shoe to be protected, at least one channel located on the underside of the sole of said cleat cover, a raised edge member extending about the periphery of said sole and at least one raised central member spaced from said edge member to define said channel, and a plurality of a cleat gripping members slideably positionable within said channel to conform to the pattern and spacing of the cleats on the golf shoe to be protected.

2. The golf shoe cleat cover of claim 1 wherein:

said edge member and said central member are formed with lateral slits opening toward said channel to slideably receive said gripping members.

3. The golf shoe cleat cover of claim 2 wherein:

the lateral dimension of said gripping members is less than the distance from the outer limit of the slit in said edge member to the inner limit of the slit in said central member to permit lateral adjustment of the position of said gripping member with respect to said channel.

4. The golf shoe cleat cover of claim 1 wherein: said sole is formed of rubber.

5. The golf shoe cleat cover of claim 1 wherein:

said sole is formed of plastic.

6. The golf shoe cleat cover of claim 1 wherein:

said edge member and said central member are formed of the same material as said sole.

7. The golf shoe cleat cover of claim 1 wherein:

said edge member and said central member are formed of material which is more rigid than that of said sole.

8. The golf shoe cleat cover of claim 1 wherein:

two of said central members are provided spaced apart longitudinally of said sole and having an open area therebetween sized to permit insertion and removal of said gripping members.

9. The golf shoe cleat cover of claim 1 wherein:

each of said gripping members is a generally rectangular member formed with a central opening of lesser diameter than that of a standard golf shoe cleat and having four slits forming an X-shaped pattern about said opening to define four tabs for gripping a cleat inserted into said opening.

10. The golf shoe cleat cover of claim 1 wherein:

said gripping members are formed of metal.

11. The golf shoe cleat cover of claim 1 wherein:

said gripping members are adjustably positionable longitudinally and laterally of said channel to correspond to the locations of the cleats on a golf shoe to be protected.

* * * * *